US006659554B2

(12) United States Patent
Su

(10) Patent No.: US 6,659,554 B2
(45) Date of Patent: Dec. 9, 2003

(54) ADJUSTMENT DEVICE OF A CHAIR BACKREST

(76) Inventor: Wen-Fa Su, No. 26, Hsing Ya Rd., Chia Yi (TW)

( * ) Notice: Subject to any disclaimer, the term of this patent is extended or adjusted under 35 U.S.C. 154(b) by 0 days.

(21) Appl. No.: 10/060,772

(22) Filed: Feb. 1, 2002

(65) Prior Publication Data

US 2003/0146652 A1 Aug. 7, 2003

(51) Int. Cl.[7] ..... A47C 1/027

(52) U.S. Cl. ..... 297/301.3; 297/301.7; 297/376

(58) Field of Search ..... 297/301.1, 301.3, 297/301.6, 301.7, 302.3, 376

(56) References Cited

U.S. PATENT DOCUMENTS 2,585,447 A * 2/1952 Eichorst ..... 297/376
3,601,444 A * 8/1971 Doerner ..... 297/301.3
4,720,142 A * 1/1988 Holdredge et al. ..... 297/303.3
4,953,259 A * 9/1990 Frye et al. ..... 297/376
6,220,664 B1 * 4/2001 Lee ..... 297/301.3

* cited by examiner

*Primary Examiner*—Peter R. Brown
(74) *Attorney, Agent, or Firm*—Rosenberg, Klein & Lee

(57) ABSTRACT

An adjustment device of a chair backrest includes a fixed member a movable member and a fixing spanner. The fixed member is fixed to a bottom of a seat of a chair. The movable member is pivoted to the fixed member, and a support rod of the backrest is connected to a rear end of the movable member. The fixing spanner is connected to an outer end of a bolt passing through both a lateral curved slot of the fixed member and a round hole of the movable member from a connecting end portion thereof so as to be turnable between an unlocking position for allowing adjustment of the backrest and a locking position for fixing the movable member after the adjustment. The fixed member further has a curved bump enclosing the curved slot. The bump has a tapering lateral side with an upper portion bigger than a lower portion thereof, whereby the backrest can be further secured in position after the adjustment.

3 Claims, 8 Drawing Sheets

ADJUSTMENT DEVICE OF A CHAIR BACKREST

BACKGROUND OF THE INVENTION

The present invention relates to an adjustment device of a chair backrest, and more particularly, an adjustment device that is easy to use and can firmly fix the chair backrest after the adjustment.

Referring to FIGS. 6~9, a conventional adjustment device of a chair backrest includes a fixed member 51, a movable member 52, a fixing member 53 and an elastic member 54. The fixed member 51 is secured to the bottom of the seat of a chair by means of screws passing through holes 511 thereof, and has two opposing lateral parts, which each has a through hole 512 and a curved slot 513.

The movable member 52 also has two opposing lateral parts 521, which each has a through hole 522, a connecting hole 524 and a through hole 525. The movable member 52 further has an insertion hole 523, through which a supporting rod of a backrest 58 is passed.

The movable member 52 is received in, and pivotably connected to, the fixed member 51 with a rod 56 passing through the through holes 522 as well as the through holes 512.

The elastic member 54 is disposed between the lateral parts 521 of the movable member 52, and has an upper end portion, a middle connecting portion, and lower end hooked portions. The rod 56 is passed through the middle portion of the elastic member 54 such that the upper end portion of same abuts the lower side of the fixed member 51. A rod 57 is passed into the connecting holes 524 of the movable member 52 and engage the lower end hooked portion of the elastic member 54 such that the rear end of the movable member 52 is biased up by the elastic member 54.

The fixing member 53 is connected to a first one of the through holes 525 by means of a bolt 531 passing through the first through hole 525, and the corresponding curved slot 513.

Thus, the fixing member 53 can be burned between a loose position for allowing the movable member 52 to be adjusted in respect of the orientation in relation to the fixed member 51, and a tight position for fixing the movable member 52 to the fixed member 51.

U.S. Pat. Nos. 1,932,618 GABB, 1,263,162 TRAVERS, 2,272,980 MCLELLAN ETAT, 3,709,525 POTHERMEL, 6,220,664 LEE, ITALIAN Patent No. 672,811 NIENBURGER, BRITISH Patent No. 857,525 THOMPSON, and SWEDISH Patent No. 127,140 GABB also have adjustment devices of the same feature, i.e. the curved slots for allowing the movable member to move relative to the fixed member.

However, the above mentioned adjustment structure is found to have a drawback that the fixing member 53 can't firmly fix the movable member 52 after the adjustment because the lateral parts of the fixed member 51 are flat and smooth, and is likely to move relative to the fixing member 53, especially when a person is sitting onto the chair. Consequently, the orientation of the chair backrest in relation to the seat after adjustment is unwantedly changed.

SUMMARY OF THE INVENTION

Therefore, it is a main object of the present invention to provide an adjustment device for a chair backrest such that the backrest can be firmly fixed in position after adjustment, without possibility of unwanted change of orientation in relation to the seat.

The adjustment device of the present invention includes a fixed member, a movable member, an elastic member, and a fixing member, which takes the form of a spanner.

The fixed member is fixed to the bottom of the seat. The movable member is pivoted to the fixed member. The backrest is connected to the rear end of the movable member. The fixing spanner is connected to an outer end of a bolt passing through both a lateral curved slot of the fixed member and a hole of the movable member from a connecting end portion thereof so as to be turnable between an unlocking position for allowing adjustment of the backrest and a locking position for fixing the movable member in position after the adjustment. The elastic member biases the rear end of the movable member upwards.

The fixed member further has a curved bump enclosing the curved slot; the bump has a lateral tapering side with an upper portion bigger than a lower portion thereof.

BRIEF DESCRIPTION OF THE DRAWINGS

The present invention will be better understood by reference to the accompanying drawings, wherein.

DETAILED DESCRIPTION OF THE PREFERRED EMBODIMENT

Referring to FIGS. 1~4, an adjustment device of a chair backrest of the present invention includes a fixed member 1, a movable member 2 an elastic member 3 and a fixing member 4.

Figure 1:
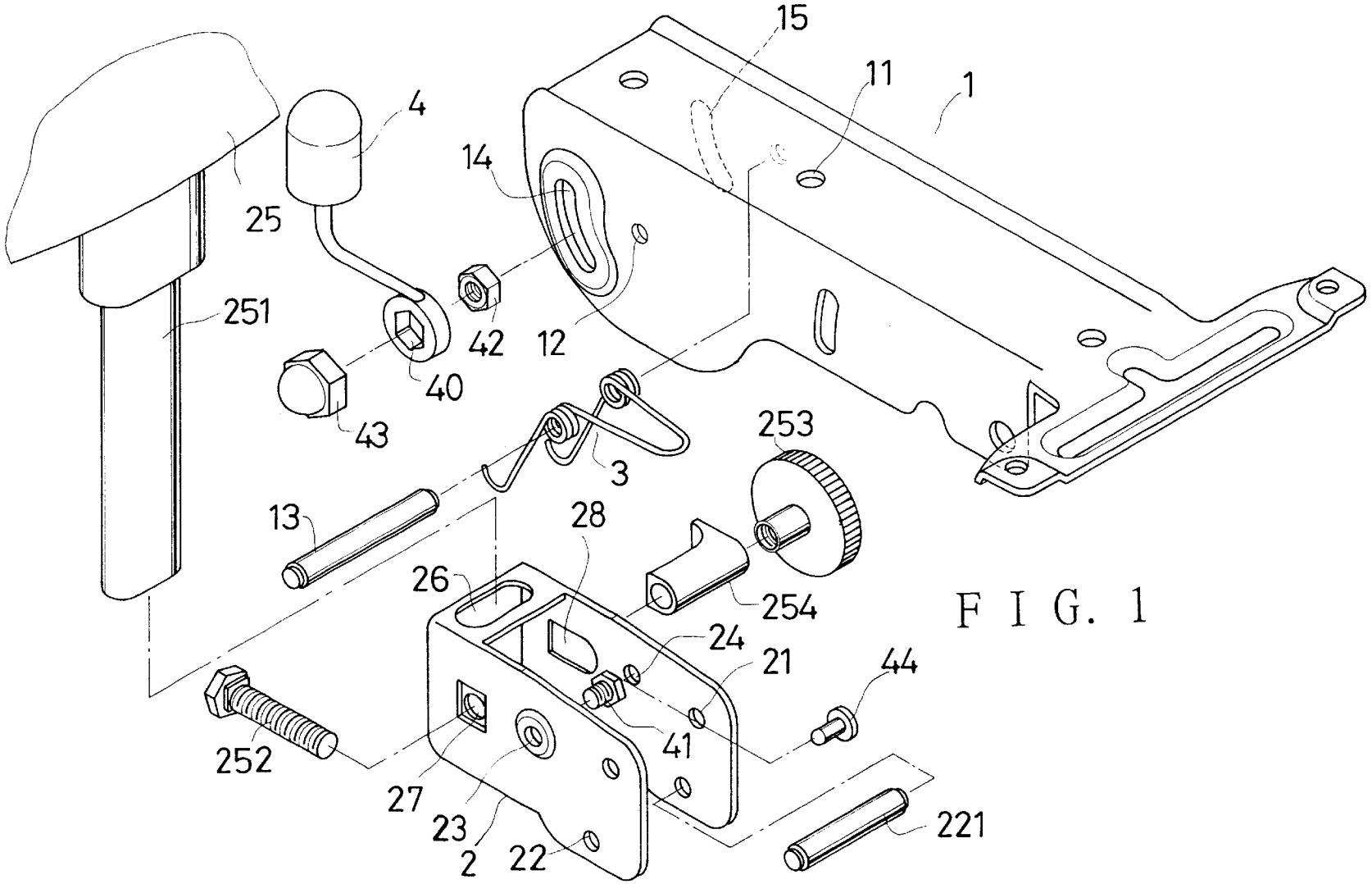
FIG. 1 is an exploded perspective view of the adjustment device of the present invention.
Figure 2:
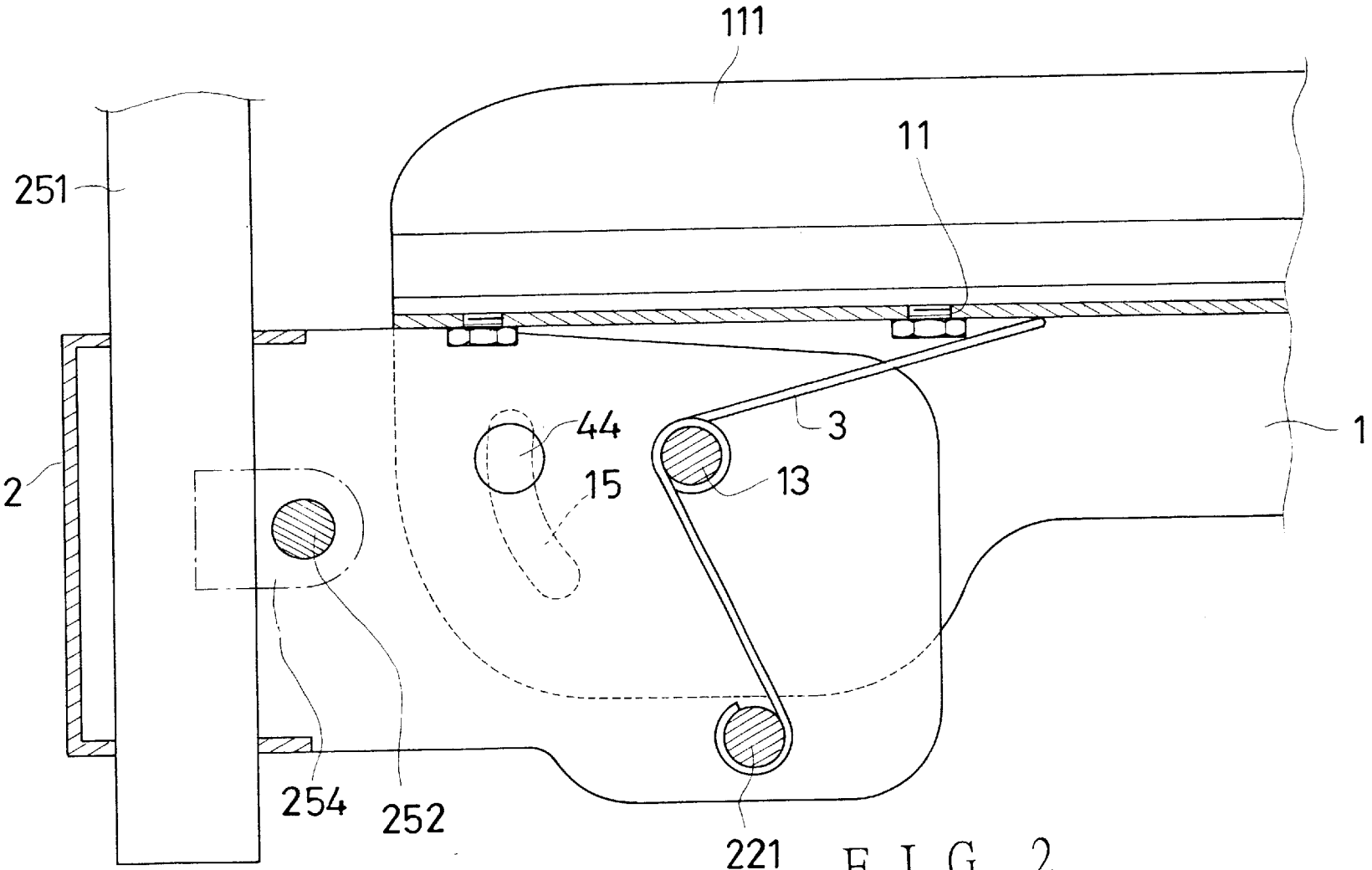
FIG. 2 is a cross-sectional view of the adjustment device of the present invention.
Figure 3:
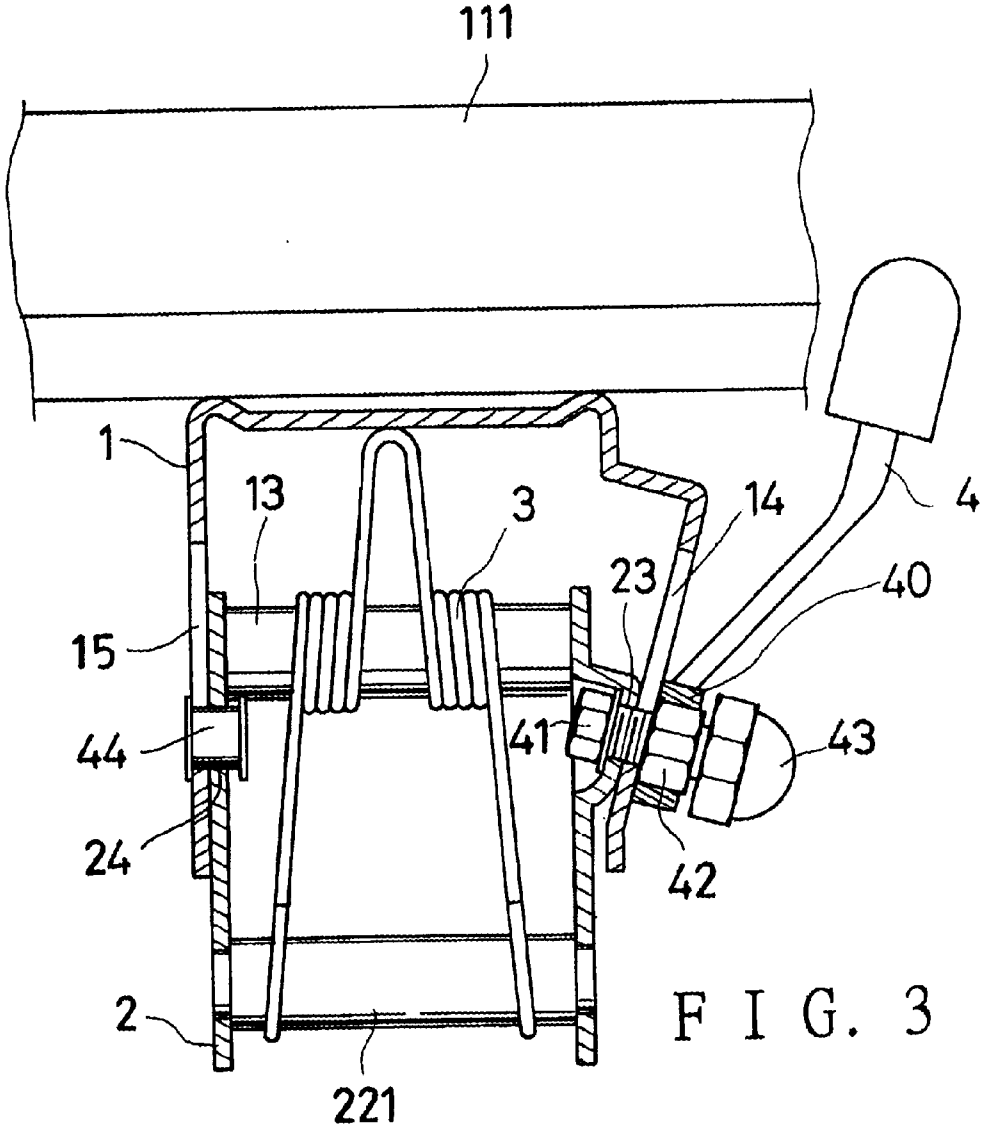
FIG. 3 is another cross-sectional view of the adjustment device of the present invention.
Figure 4:
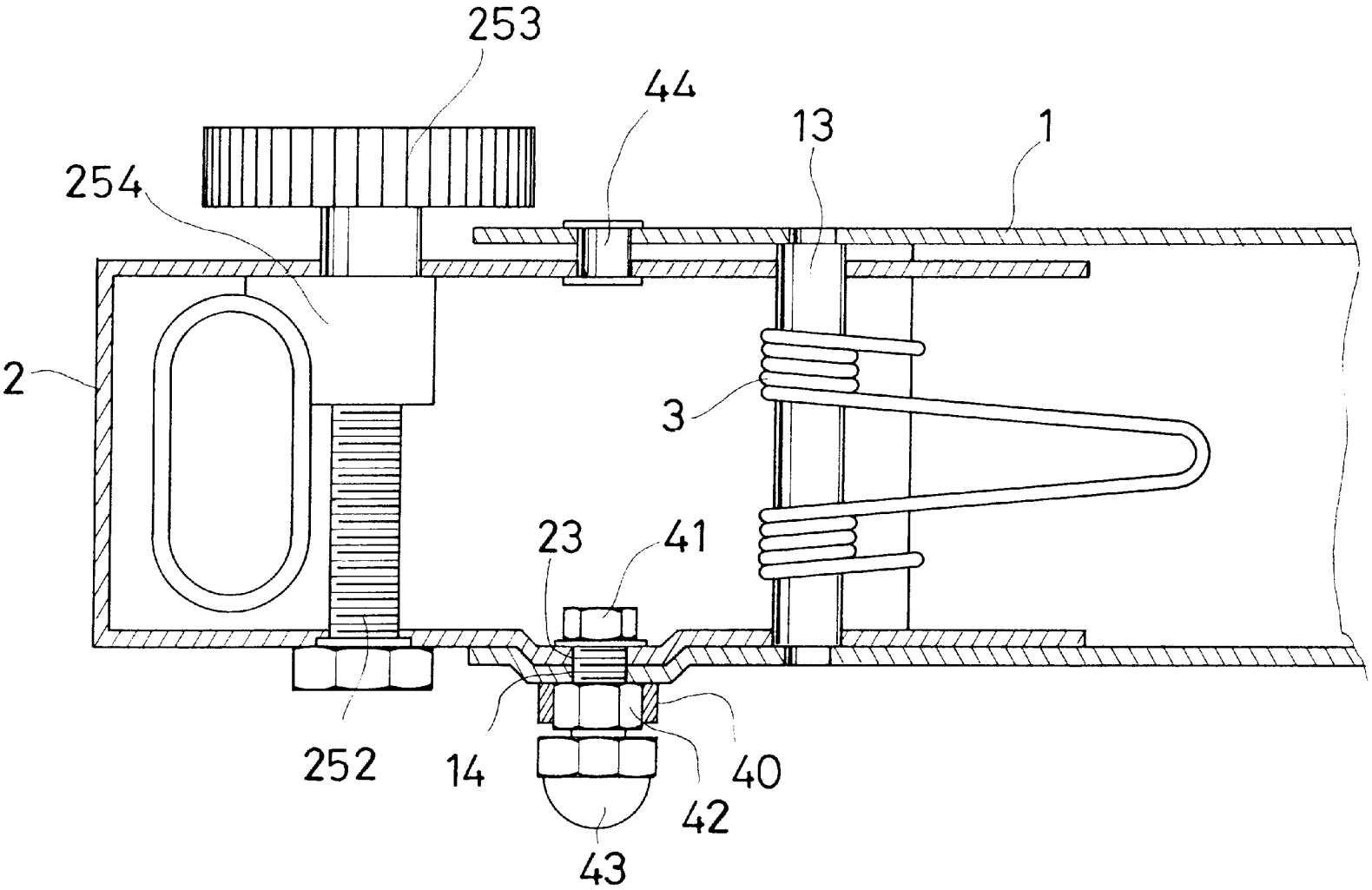
FIG. 4 is a third cross-sectional view of the adjustment device of the present invention.
Figure 5:
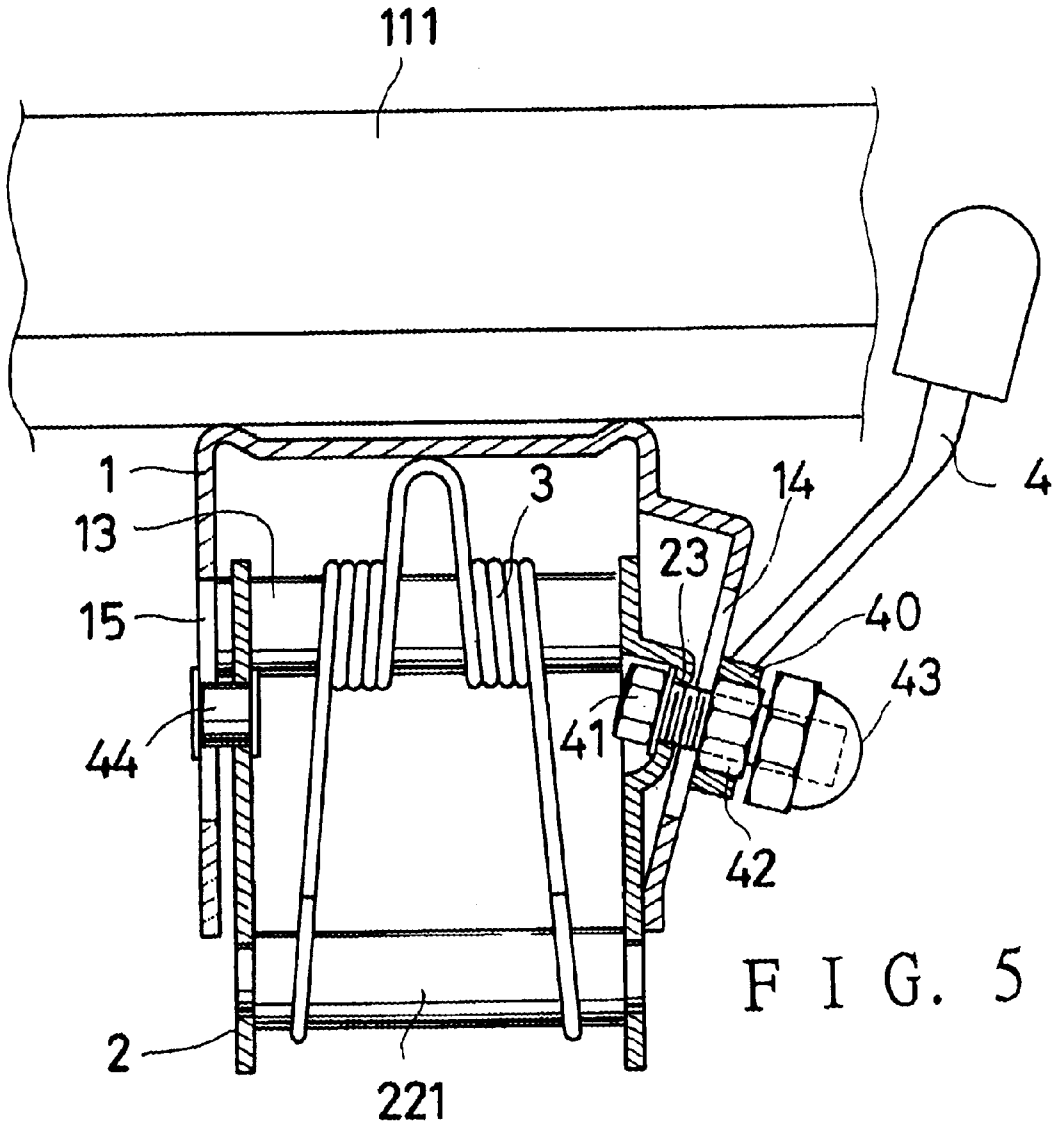
FIG. 5 is a view showing the operation of the adjustment device of the present invention.
Figure 6:
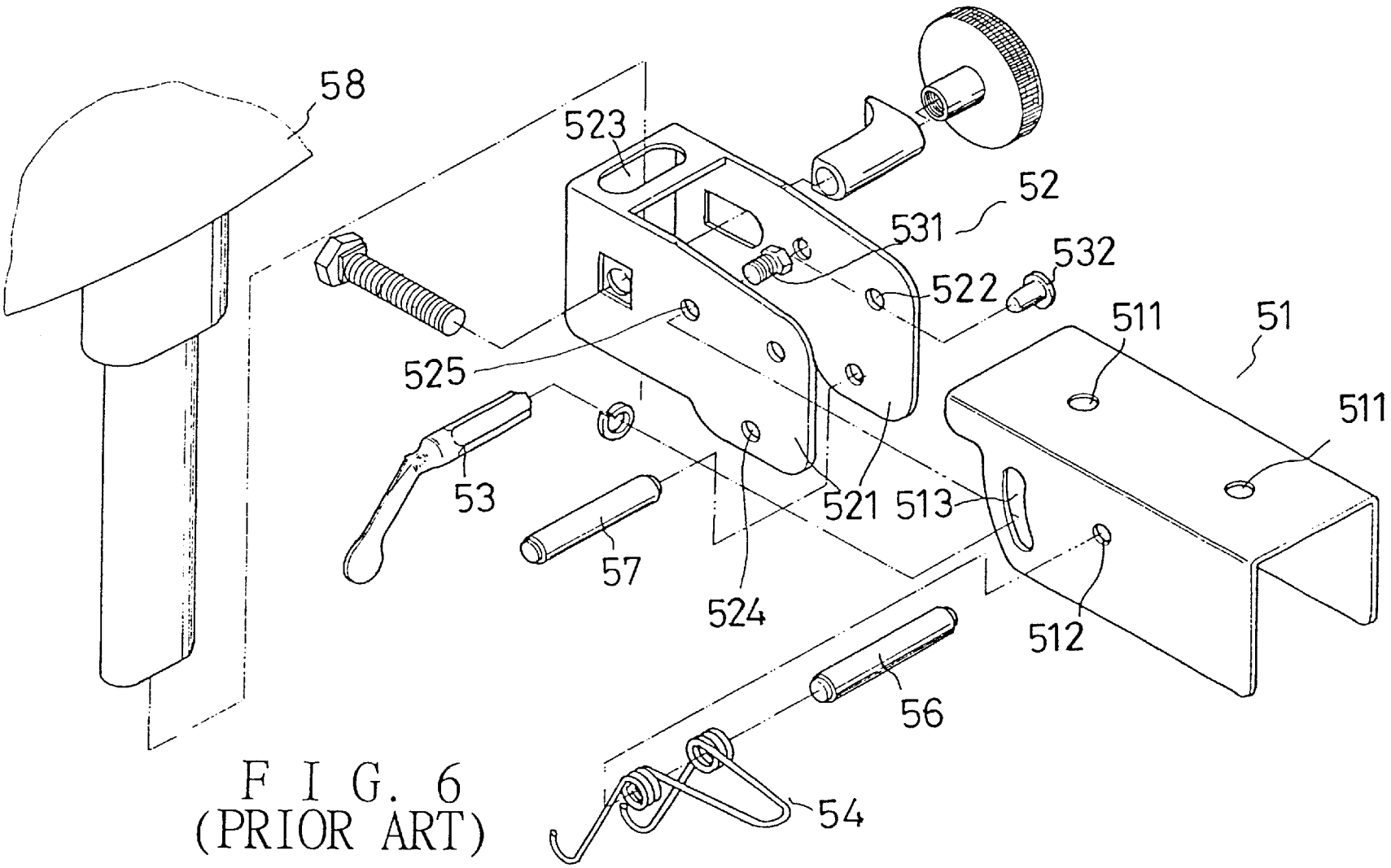
FIG. 6 (PRIOR ART)
FIG. 6 is a perspective view of the conventional adjustment device of the present invention.
Figure 8:
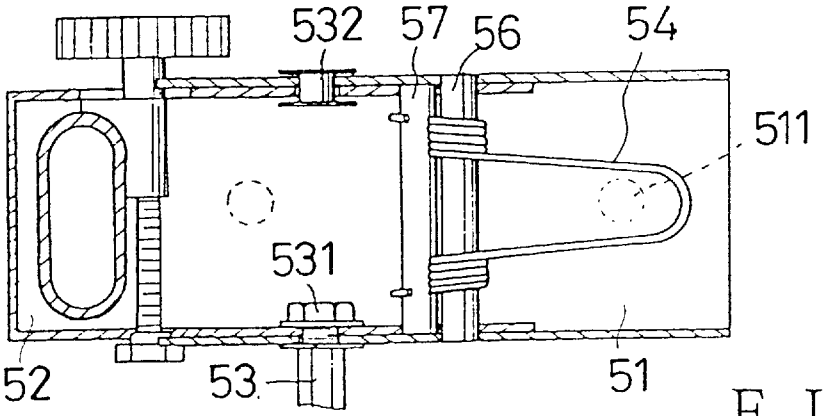
FIG. 8 (PRIOR ART)
FIG. 8 is another cross-sectional view of the conventional adjustment device of the present invention.
Figure 7:
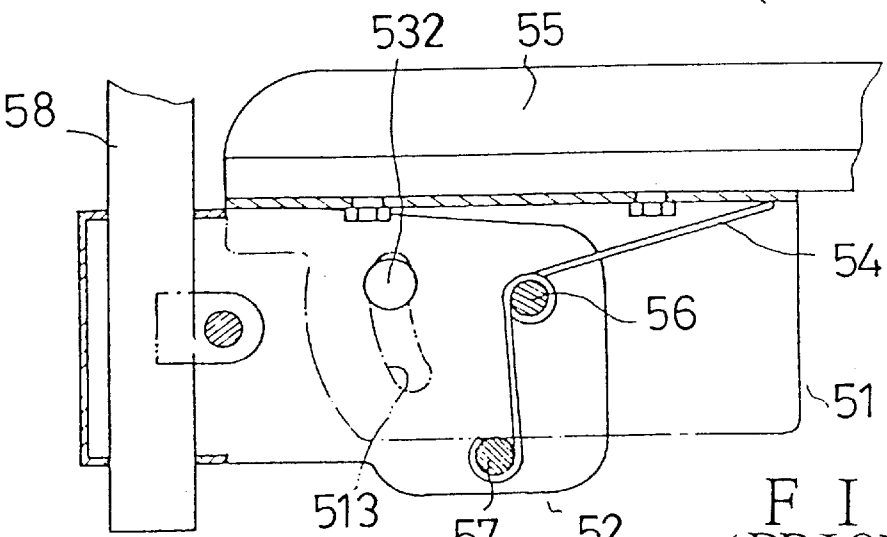
FIG. 7 (PRIOR ART)
FIG. 7 is a cross-sectional view of the conventional adjustment device of the present invention.
Figure 9:
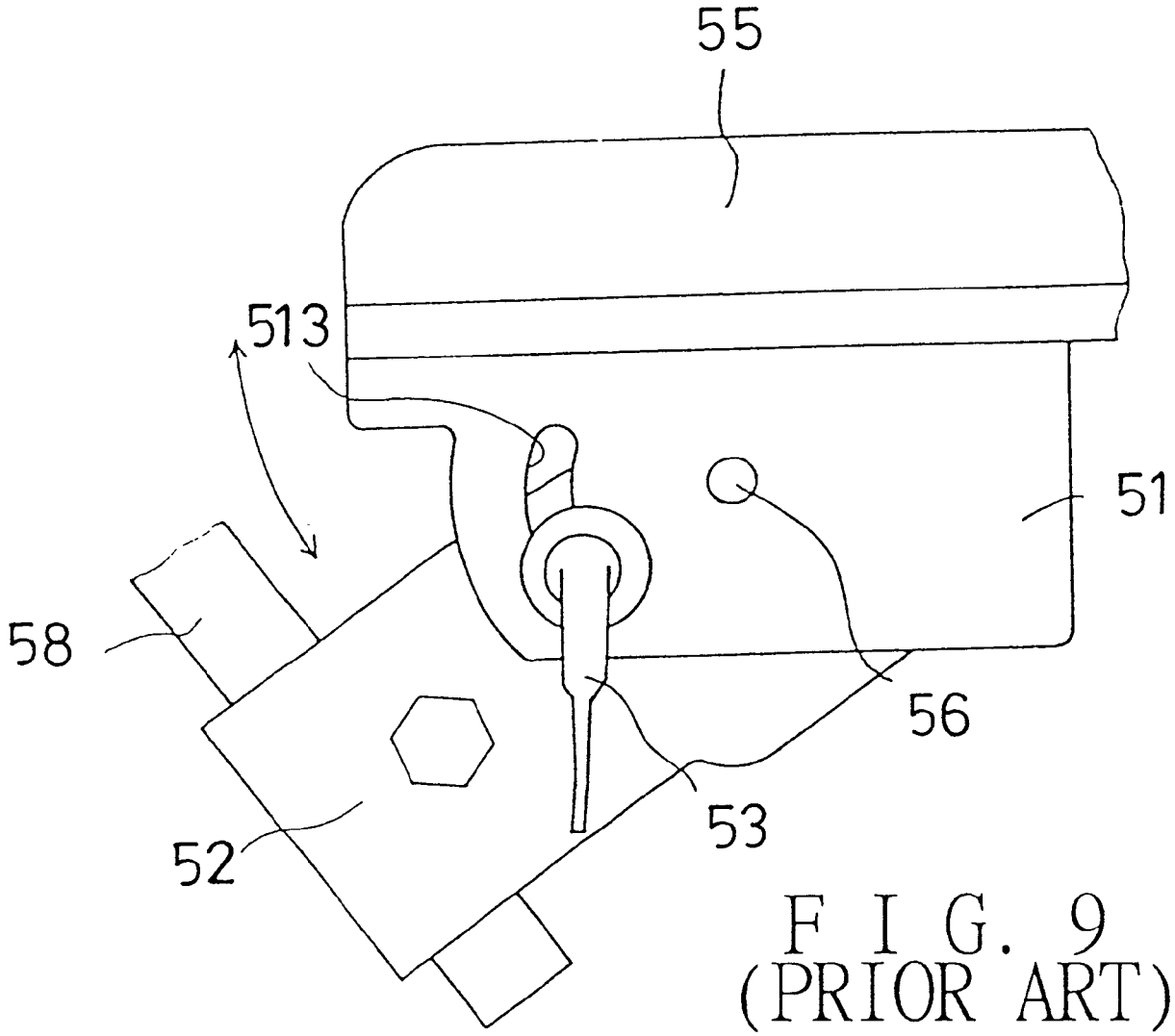
FIG. 9 (PRIOR ART)
FIG. 9 is a view showing the operation of the conventional adjustment device of the present invention.

The fixing member 1 has a horizontal part, and two opposing lateral parts; the horizontal part has through holes 11 thereon, and is fixedly fitted to the bottom of a seat 111 of a chair by means of screws passing through the holes 11. The lateral parts have opposing through holes 12, and opposing curved slots 14 and 15 at the rear end portion; a first one of the curved slots 14 is enclosed by a curved bump. The curved bump enclosing the curved slot 14 is shaped such that the upper portion thereof is bigger than the lower portion, i.e. the curved bump tapers off toward the lower portion, as shown in FIG. 2.

The movable member 2 has two opposing lateral parts, which have first opposing holes 21, opposing connecting holes 22, and third opposing holes 23 and 24. A first one of the lateral parts of the movable member 2 has a fourth hole 27, while the other lateral part has a holding hole 28 facing the fourth hole 27. The hole 23 is enclosed by a circular bump, having an upper portion which is bigger than the lower portion, i.e. the circular bump tapers off toward the lower portion. The movable member 2 is substantially received in, and pivoted to, the fixed member 1; a pivotal rod 13 is passed through a middle portion of the elastic member 3, and the first holes 21 as well as the through holes 12 of the fixed member 1 such that an upper end portion of the elastic member 3 abuts the bottom of the horizontal part of the fixed member 1. A connecting rod 221 is passed into the connecting holes 22 of the movable member 2, and engage lower end hooked portions of the elastic member 3 such that the rear end of the movable member 2 is biased upwards by the elastic member 3.

The fixing member 4 can take the form of a spanner, and has a lower end connecting portion 40. A bolt 41 is passed through the hole 23 of the movable member 2, the curved slot 14 enclosed by the curved bump, and screwed into a nut 42 disposed adjacent to the curved bump. The connecting portion of the fixing member 4 is connected to the nut 42 such that it can be turned between an unlocking loose position for allowing adjustment of the orientation of the movable member 2 in relation to the fixed member 1, and a tight locking position after the adjustment is performed. A covering part 43 is screwed onto the outer end of the bolt 41 to prevent the fixing member 4 from falling out. Another shaft 44 is passed through the hole 24 and the curved slot 15.

The backrest 25 of the chair has a supporting rod 251, which is passed through the insertion hole 26 of the movable member 2. A bolt 252 is passed through the fourth hole 27, the holding hole 28 of the movable member 2, and a fixing block 254, and screwed into a tube portion of a knob 253; the fixing block 254 is disposed between the lateral parts of the movable member 2 to contact the supporting rod 251 of the backrest 25. Thus, the knob 253 can be turned loose for allowing the backrest to be adjusted in respect of the height.

When the fixing member 4 is turned to the tight position after adjustment of the position of the movable member 2, the connecting portion 40 thereof will come into contact with the curved bump of the curved slot 14.

From the above description, it can be easily understood that the adjustment device of a chair backrest of the present invention has an advantage that the circular bump, having bigger height at the upper portion, can move slightly down relative to the fixed member 1 when a person is sitting on the chair, thus engaging the same further so as to help the movable member 2 firmly fixed in position after adjustment.

What is claimed is:

1. An adjustment device of a chair backrest, comprising:

a fixed member fixedly fitted to a bottom of a seat of a chair;

a movable member pivoted to said fixed member, said chair backrest being connected to a rear portion of said movable member from a supporting rod thereof;

an elastic member biasing said rear portion of said movable member upwards;

a fixing member connected to an outer end of a bolt passing through both a lateral curved slot of said fixed member and a hole of said movable member from a connecting portion thereof so as to be trunable between an unlocking position where said movable member is pivotable in relation to said fixed member for adjustment of the orientation of said backrest in relation to said seat and a locking position where said movable member is fixed to said fixed member; and characterized by a curved bump formed on said fixed member; said curved bump enclosing said curved slot and having a tapering lateral side with an upper portion at least slightly bigger than a lower portion thereof, whereby the securement of said backrest relative to said fixed member when locked by said fixing member is reinforced against release when a person sitting on said seat leans against said backrest.

2. The adjustment device of a chair backrest as claimed in claim 1, wherein said hole of said movable member is provided with a circular bump formed thereabout to face a part of said fixed member that is formed with said curved bump.

3. The adjustment device of a chair backrest as claimed in claim 1, wherein the fixing member takes a form of a spanner.

* * * * *